US007862039B1

(12) United States Patent
Werner

(10) Patent No.: US 7,862,039 B1
(45) Date of Patent: Jan. 4, 2011

(54) MULTI-BIN PRINTER

(75) Inventor: Todd C. Werner, St. Petersburg, FL (US)

(73) Assignee: Pitney Bowes Inc., Stamford, CT (US)

( * ) Notice: Subject to any disclaimer, the term of this patent is extended or adjusted under 35 U.S.C. 154(b) by 1880 days.

(21) Appl. No.: 10/709,289

(22) Filed: Apr. 27, 2004

(51) Int. Cl.
*B65H 43/04* (2006.01)

(52) U.S. Cl. ..... 271/198; 271/2; 271/298

(58) Field of Classification Search ..... 209/584, 209/900; 271/2, 183, 298, 198
See application file for complete search history.

(56) References Cited

U.S. PATENT DOCUMENTS 4,863,037 A * 9/1989 Stevens et al. ..... 53/381.3
5,083,769 A * 1/1992 Young, Jr. ..... 271/280
5,195,641 A * 3/1993 Signoretto ..... 209/698
5,253,859 A * 10/1993 Ricciardi ..... 271/176
5,417,414 A * 5/1995 Belec et al. ..... 271/178
5,441,159 A * 8/1995 DeWitt et al. ..... 209/584
5,460,273 A * 10/1995 Stevens et al. ..... 209/584
5,464,099 A * 11/1995 Stevens et al. ..... 209/3.1
5,518,121 A * 5/1996 Stevens et al. ..... 209/1
5,538,140 A * 7/1996 Guenther et al. ..... 209/552
5,755,336 A * 5/1998 Rudy ..... 209/539
5,772,200 A * 6/1998 Sorensen ..... 271/11
5,842,577 A * 12/1998 Stevens et al. ..... 209/3.3
5,842,693 A * 12/1998 Stevens et al. ..... 271/4.01
6,064,023 A * 5/2000 Lile et al. ..... 209/569
6,112,902 A * 9/2000 Hayduchok et al. ..... 209/3.3
6,241,460 B1 6/2001 Werner
6,303,889 B1 * 10/2001 Hayduchok et al. ..... 209/584
6,311,846 B1 * 11/2001 Hayduchok et al. ..... 209/3.3
6,613,998 B2 * 9/2003 DeWitt et al. ..... 209/583
6,897,394 B1 * 5/2005 Dibiaso et al. ..... 209/584
6,969,059 B2 * 11/2005 Gafner ..... 271/69
7,029,002 B2 * 4/2006 Engarto et al. ..... 271/2
7,041,927 B2 * 5/2006 DeWitt et al. ..... 209/584
7,121,544 B2 * 10/2006 Masotta et al. ..... 271/209
2002/0070149 A1 * 6/2002 Schererz et al. ..... 209/540
2004/0232055 A1 * 11/2004 Reboul et al. ..... 209/584
2004/0245158 A1 * 12/2004 Redford et al. ..... 209/584

OTHER PUBLICATIONS

Definition of "O-ring". American Heritage Dictionary of the English Language, 4th Ed. Houghton Mifflin, 2000 [cited Mar. 17, 2007]. Available from http://www.bartleby.com.*

* cited by examiner

*Primary Examiner*—Stefanos Karmis
*Assistant Examiner*—Jeremy Severson
(74) *Attorney, Agent, or Firm*—Michael J. Cummings; Angelo N. Chaclas

(57) ABSTRACT

A high-speed printing and sorting machine. A first diverter diverts a first batch of items into a first bin, a second diverter diverts a second batch into a second bin, and so on. A plurality of O-rings and flat belts confront one another and rotate in opposite directions to carry diverted items to their respective bins. A nip formed by opposed rollers causes the items to slow down. Protruding rollers constrain the items to momentarily deviate from a path of travel and the inherent resiliency of the O-rings is harnessed to snap the trailing ends of each slowing down leading item out of the way of the trailing item so that shingling may occur. If a gap between items is too large, the opposed rollers of the nip stop rotating until the gap is restored to a preferred distance so that the desired amount of shingling may be maintained.

13 Claims, 6 Drawing Sheets

MULTI-BIN PRINTER

BACKGROUND OF INVENTION

1. Field of the Invention

This invention relates to high-speed printers. More particularly, it relates to a printer having multiple bins into which items are sorted after printing.

2. Description of the Prior Art

U.S. Pat. No. 6,241,460 to the present inventor, entitled: "Offset Sorter For Envelopes," discloses a sorter that separates bundles of items to be mailed from one another. A first wall is extended as a first bundle of items is received within a bin so that the leading edge of each item is aligned with the first wall. The first wall retracts when a bundle has been completed and the items of the next bundle travel a little further along their path of travel until they encounter a second wall. The leading edge of each item in the second bundle thus aligns with the second wall. After that bundle has been completed, the first wall is again extended. Thus, each bundle is physically staggered from the bundle in front of it or behind it so that a worker can easily separate the bundles from one another. In most cases, the worker will insert a separator or divider sheet between contiguous bundles to divide them from one another.

After the separator/divider sheets have been inserted, the worker transfers all of the bundles in a bin to a postal container for delivery to the postal service. The worker must also maintain a steady flow of envelopes into the hopper of the machine. Thus, the worker is busy keeping the hopper full and emptying the bin as it is filled.

It would therefore be advantageous to provide a machine having multiple bins so that a second bin can begin to fill while items are being manually removed from a first full bin. Where a machine operates at a very high speed, it would be advantageous to add a third, a fourth, and even higher numbers of bins so that the machine would not need to operate at a slow speed just to facilitate manual removal of items from the bins.

It would also be advantageous if automatic means could be provided to insert a divider sheet or other bundle-dividing marker between contiguous bundles to lower the effort required by the machine operator and to reduce the number of mistakes that an operator may make when manually inserting such divider sheets.

Another problem with high-speed machines is that envelopes and other items have to slow down when they enter into a nip (defined by a pair of opposing rollers). When a leading envelope slows down upon encountering a nip, the leading end of a trailing envelope collides with the trailing end of the leading envelope.

In prior art machines, the nip rollers do not rotate during a time that multiple envelopes are accumulating upstream of the nip. Accordingly, the respective leading ends of all of the envelopes or other items are aligned with one another as such items accumulate. When a predetermined number of envelopes have accumulated, forming a bundle, the nip rollers are activated and the bundle of envelopes is moved through the nip to a collection station or bin. As soon as the bundle has passed through the nip, the rollers stop turning and envelopes again begin to accumulate.

However, there is a need for a high-speed machine where envelopes or other items do not accumulate upstream of a non-rotating nip. In other words, there is a need for a continuously rotating nip where no accumulation occurs and each envelope approaching a nip is carried therethrough at a high rate of speed. In such a machine, the leading ends of the items would be staggered, i.e., shingled with respect to one another. By keeping the nip rollers rotating substantially at all times, the quantity of items that could be handled would significantly increase.

An item such as an envelope will slow down when its leading end encounters a nip, even when the nip is rotating. Accordingly, the leading end of a trailing envelope will collide with collide with the trailing end of the leading envelope as aforesaid. This problem, heretofore unsolved, prevents operation of very high speed printing machines having rotating nips. Instead, as mentioned above, the machines must be equipped with nips that do not rotate during bundle-formation. Even when so configured, the speed with which a bundle may be formed is limited by the fact that the respective leading ends of trailing items will collide with the respective trailing ends of leading items.

Accordingly, there is a need for a structure that enables a leading envelope to slow down upon encountering a nip, but which moves the trailing end of such envelope out of the path of travel of a trailing envelope so that the leading end of the trailing envelope does not contact the trailing end of the leading envelope.

Such a structure would speed up the formation of a bundle of items in a machine of the type where envelopes or other items are accumulated in a bundle before passing through a nip.

Such a structure would also facilitate operation of a machine having rotating nips where a lead envelope slows down upon encountering a nip but where no envelopes are accumulated in a bundle upstream of the nip. The trailing envelope would then overlie a large part of the leading envelope in the aforementioned configuration known as "shingling." When two envelopes are in shingled relation to one another, the trailing envelope is disposed in overlying relation to the leading envelope and the leading end of the trailing envelope is disposed in trailing relation to the leading end of the leading envelope. The amount of shingling may vary. For example, there may be one inch of shingling, two inches, two and one-half inches, and so on.

One drawback associated with such shingling is that a trailing envelope may be too far behind a leading envelope to create the proper amount of shingling. There is a need, therefore, for a machine that can detect a gap between envelopes of other items that exceeds a predetermined gap, and that can reduce that gap as needed so that proper shingling may occur.

Very high-speed printing machines also cause problems with ink-drying. The ink on an envelope or other item leaving a printer may not have sufficient time to dry before entering a sorter that directs the items to various bins.

Thus there is a need for a high-speed machine that efficiently dries the ink on items prior to entry of such items into a sorter.

However, in view of the prior art taken as a whole at the time the present invention was made, it was not obvious to those of ordinary skill how the identified needs could be met.

SUMMARY OF INVENTION

The long-standing but heretofore unfulfilled need for a very high speed machine that enables ink-drying prior to item sorting, that prevents collisions between items as they slow down to enter a nip, and that maintains proper spacing between items so that proper shingling may be achieved, is now met by a new, useful, and non-obvious invention.

The novel high-speed printing machine includes a conveyor system for transporting items to a hopper, to a printer station where ink is applied to the items, to a drier station where the ink is dried, and to a sorter or other discharge apparatus that divides the items into bundles and delivers the bundles to a plurality of bins. The path of travel from the printer to the sorter is elongated to increase the dwell time between such printer and sorter. However, the elongation does not increase the amount of space occupied by the machine because the path of travel includes two reversals of direction.

A friction belt that follows a triangular path of travel is pivotally mounted at the envelope hopper. When in an unpivoted position of repose it engages substantially the entire length of an envelope to be frictionally engaged and moved out of the hopper. When in its fully pivoted position, the belt engages only the leading end of the envelope. Differing extents of the envelopes are engaged in the intermediate positions between the unpivoted and fully pivoted positions. Increasing contact increases the amount of driving force imparted to the envelope as it leaves the hopper.

The machine includes a separator or divider sheet inserter means positioned between the printing and drying stations of the machine and the sorting stage. The machine includes a computer having a memory within which is stored instructions about how the items are to be handled. For example, the instructions might command, for example, that the first one thousand, six hundred twelve envelopes to be printed are to have a first ZIP code and are to form a first discrete bundle and are to be diverted into a first bin after printing and drying. The instructions might further command that the one thousand, six hundred thirteenth envelope and the two thousand, four hundred ninety two envelopes following it are to be printed with a second ZIP code and diverted to the same bin, or to a second bin, and so on. The computer scans the instructions and executes the commands as instructed. In addition to causing the correct number of envelopes to be printed with a correct ZIP code, it also causes insertion of a separator/divider sheet between bundles as needed and controls the means for diverting the bundles to the various bins of the machine.

The bundles need not be divided by ZIP codes. The machine's computer may be programmed to cause bundling of items in accordance with other parameters.

The sorter apparatus includes a plurality of diverter means for diverting preselected envelopes or other items having addresses printed thereon from a first path of travel to a second path of travel. A plurality of bins is disposed in item-receiving relation to the plurality of diverter means, there being as many bins as there are diverter means.

The device for inserting separator sheets is positioned upstream of the diverter means and downstream of the printing and drying stations.

A sensor including a signal-generating means is positioned upstream of the sorter. The signal-generating means controls an instantaneous position of each diverter means so that a preselected group of items may be diverted to a particular bin.

Each diverter means includes a deflector and each deflector has a first position and a second position. The first position of each deflector is disposed in non-interfering relation to a first path of travel of an item so that the item remains on the first path of travel after passing its associated deflector.

The second position of each deflector is disposed in interfering relation to the first path of travel of an item so that the item is diverted to a second path of travel upon encountering the deflector in said second position.

Where a plurality of collection bins is provided, there are as many diverters as there are bins. Thus, a first deflector diverts items from the first path of travel to a second path of travel that terminates in a first bin. A second deflector diverts items from the first path of travel to a third path of travel that terminates in a second bin, and so on. All items are diverted because an item remaining on the first path of travel would not be diverted into any collection bin. For clarity purposes, each path of travel that deviates from the first path of travel will hereinafter be referred to as a second path of travel, it being understood that the aforesaid third path of travel is therefore generically referred to as a second path of travel.

In a preferred embodiment, each deflector is pivotally mounted and is selectively pivoted between the first and second positions by a solenoid having an actuator that is linked to the deflector. Each solenoid has an inactivated state where the actuator maintains the deflector in a first position and each solenoid has an activated state where the actuator causes pivotal motion of the deflector and places the deflector in the second position. The use of a solenoid is not critical. Any suitable means for causing a deflector to operate is within the scope of this invention. Nor must the deflector be pivotally mounted. It is merely required to have a first position and a second position. One of those positions must deflect an item from a first path of travel to a second path of travel and the other of those positions must not.

A plurality of elongate O-rings and flat belts is rotatably mounted along each second path of travel. More particularly, a first plurality of O-rings, disposed in laterally spaced relation to one another, is positioned in juxtaposition with a second plurality of flat belts, said flat belts also being spaced in lateral relation to one another. The O-rings and flat belts rotate cooperatively with one another so that an envelope or other item held between them is transported along a predetermined path of travel.

More particularly, an envelope or other item is transported between the O-rings and the flat belts as said O-rings and flat belts rotate at the same speed in opposite directions to one another. For example, where an item is being transported from right to left, as viewed from above, the O-rings would rotate counterclockwise and the flat belts would rotate clockwise.

A plurality of vertically spaced apart rollers is positioned at a preselected location along the second path of travel. Each roller of the plurality of rollers protrudes slightly into the path of travel of an item that has been deflected from its first path of travel. A flat belt of the plurality of flat belts extends over each of the protruding rollers so that an item being carried between confronting O-rings and flat belts is constrained to divert slightly away from its path of travel as it passes over the protruding rollers.

Accordingly, a leading end of a leading item encounters the protruding rollers and is displaced from its second path of travel by the protruding rollers. As a practical matter, the amount of protrusion may be a small amount such as a quarter of an inch or so. The leading end of an item is displaced when it encounters the protruding rollers and such displacement causes displacement of the O-rings from their respective positions of repose. When a trailing end of the leading item clears the protruding rollers, the inherent resiliency of the O-rings causes the O-rings to snap back into to their respective positions of repose. The envelope or other item is wider than the lateral spacing between the O-rings so that when the O-rings snap back into their respective positions or repose, such action snaps the trailing end of the envelope or other item to the bottom of the protruding rollers, thereby removing the trailing end of a leading item out of the path of travel of the leading end of the item that trails the leading item.

At a very high rate of speed, the trailing end of each item may bounce as it clears the protruding rollers and is snapped back into the path of travel that was being followed prior to encountering the protruding rollers. This problem is overcome by providing a plurality of openings downstream of the protruding rollers, in close proximity thereto, and coupling those items to a vacuum source. As the trailing end of the items clear the protruding rollers and are snapped back into their initial positions by the O-rings, the vacuum acts upon the trailing ends and prevents such trailing ends from bouncing.

Where the items passing over the protruding rollers are envelopes, the flaps of a leading envelope may interfere with the flap of a trailing envelope because both flaps may protrude outwardly from the plane of their respective envelopes. This problem is overcome by positioning a nozzle that delivers air under positive pressure to the flaps of each passing envelope so that the flaps are pressed against the main body of the envelope.

When the envelopes of other items have a common spacing between them as they approach the protruding rollers (there being no shingling or overlapping of the envelopes as they approach the protruding rollers), the amount of shingling that occurs as the envelopes encounter the nip will remain constant. As an example, suppose the envelopes are spaced about two inches from one another as they encounter a deflector and are diverted into a second path of travel that leads to a bin. That spacing is maintained until they encounter the protruding rollers. As the trailing end of an envelope clears the protruding rollers, the leading end of that envelope encounters the nip and thus the forward speed of the leading envelope is slowed. With the above-described action of the O-rings, the protruding rollers, and the bounce-suppressing vacuum, the trailing end of the leading envelope will be quickly moved out of the path of travel of the leading end of the trailing envelope and the trailing envelope, still traveling at the initial rate of speed, will overlie the leading envelope in the aforementioned shingling relation where the leading end of the trailing envelope is disposed a half inch (for example) in trailing relation to the leading end of the leading envelope. In other words, the nip-caused slowing down of the leading envelope allows it to be overtaken by a trailing envelope. However, the leading end of the trailing envelope also encounters the nip when the trailing end of the trailing envelope clears the protruding rollers so said trailing envelope does not completely overtake the leading envelope. Thus, the aforementioned shingling is observed.

Problems arise when the envelopes approaching the protruding rollers are spaced too far from one another. If the spacing is too great, the trailing envelope will not overtake the leading envelope even when the leading envelope is slowed down by the nip. Thus, the leading end of the trailing envelope may be several inches from the leading end of the leading envelope when a shingling distance of only a half-inch, for example, is required.

A gap sensor is positioned downstream of the protruding rollers to solve this problem. If a gap is detected that exceeds the predetermined required gap, a clutch mechanism is activated to stop rotation of the nip rollers for a computer-calculated predetermined amount of time so that the lead envelope is required to wait for the trailing envelope to catch up. When the trailing envelope catches up, the clutch releases and the nip rollers resume their rotation. The computer makes its calculations based upon the linear rate of speed of items through the machine.

A primary advantage of the invention is that it enables printing and sorting of items at a rate of approximately sixty thousand (60,000) items per hour. This speed greatly exceeds the speed of prior art machines.

A closely related advantage is the provision of multiple bins so that a bin need not be emptied immediately when it is filled with items.

Another important advantage is that when items slow down as they encounter a nip, means are provided to quickly remove the trailing end of a slowing down item from the path or travel of a trailing item that continues to travel at full speed because it has not yet encountered the nip.

Still another advantage, closely related to the preceding advantage, lies in the use of elongate O-rings to provide the bias needed to quickly snap the trailing end of a slowing-down, leading item to a lower level when said trailing end clears a plurality of protruding rollers.

Yet another advantage is the provision of vacuum means that prevent the trailing end of an item from bouncing after it has cleared the protruding rollers.

Another advantage is the provision of a positive pressure air flow to hold an envelope flap against the main body of an envelope as the envelope clears the protruding rollers.

Another advantage is the provision of means for maintaining the proper amount of shingling between items even if the items are not properly spaced from one another after clearing the protruding rollers.

Another advantage is that each diverter means for diverting items into multiple bins is of simple reliable construction and is under the control of a solenoid.

Yet another advantage is the drying stage of the machine that enables ink on items to dry before encountering the diverter and the elongate O-rings and flat belts that transport the items to the various bins.

Another advantage is the ability of the pivotally mounted friction belt that engages envelopes leaving the hopper to impart varying degrees of driving force to such envelopes, depending upon the amount of pivoting.

Another advantage lies in the ability of the novel machine to automatically insert separator sheets between bundles, thereby reducing the work that must be performed by a human machine operator.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
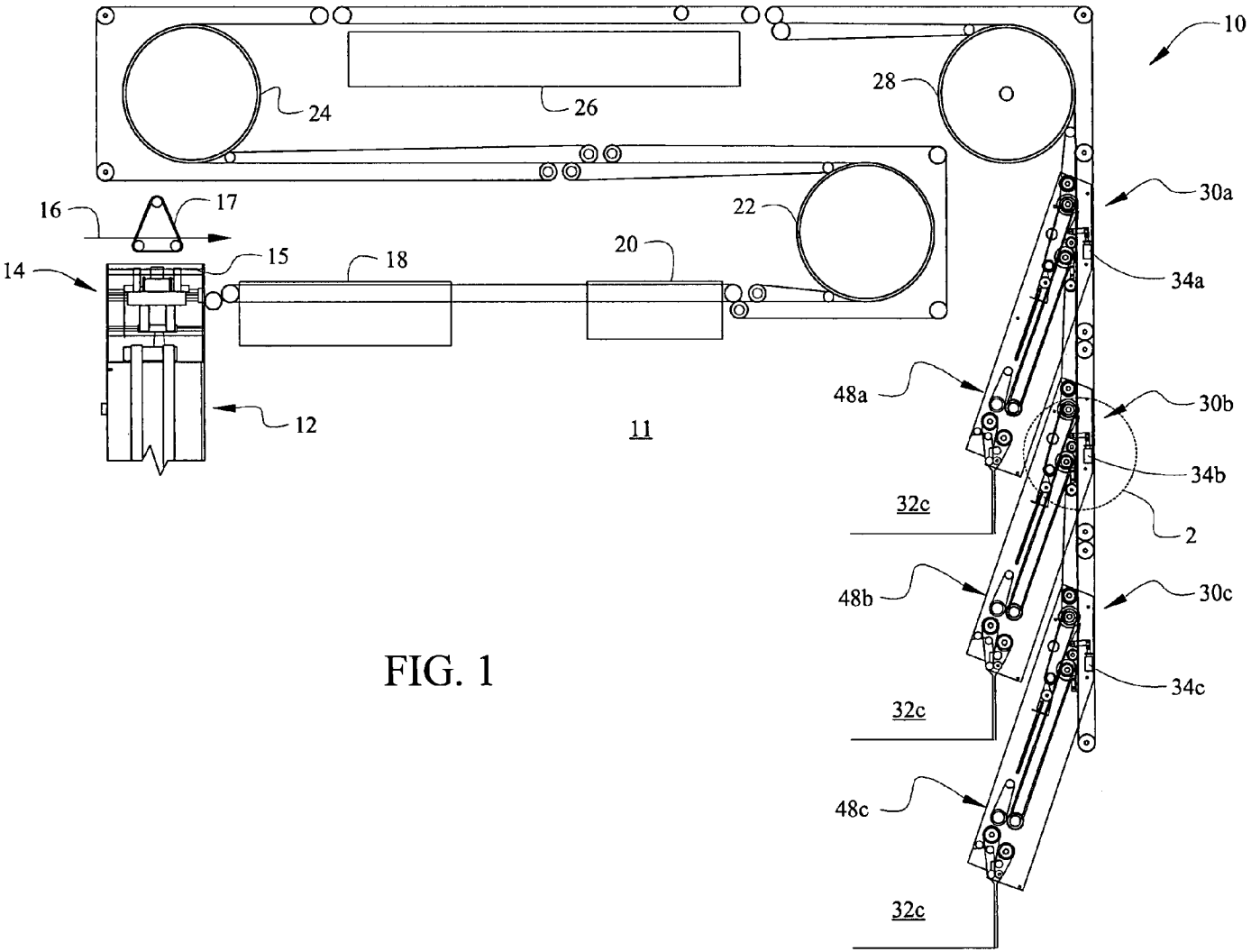
FIG. 1 is a top plan view of the novel machine, depicting three (3) bins.

Referring now to FIG. 1, it will there be seen that an illustrative embodiment of the invention is denoted as a whole by the reference numeral 10.

Machine 10 is a very high-speed printing machine capable of printing addresses or the like on items such as envelopes at a rate of about sixty thousand (60,000) items per hour.

Machine 10 includes elongate, horizontally disposed conveyor means 12 that holds a large supply of items such as envelopes 15 so that a worker is not required to frequently replenish the supply. Each envelope is positioned in a vertical plane as it sits atop conveyor means 12, with the long end thereof in contact with said conveyor means. Each envelope is oriented so that its flap is on top. Moreover, the envelopes are disposed in lateral or transverse relation relative to the longitudinal axis of conveyor means 12.

As they reach the discharge end of conveyor means 12, each individual envelope 15 enters into envelope hopper 14 and exits therefrom without changing its vertical orientation. However, as indicated by directional arrow 16, hopper 14 changes the path of travel of each envelope by ninety degrees (90°). Upon exiting hopper 14, each envelope enters into a printing and drying station that includes one printer and two driers.

Figure 1A:
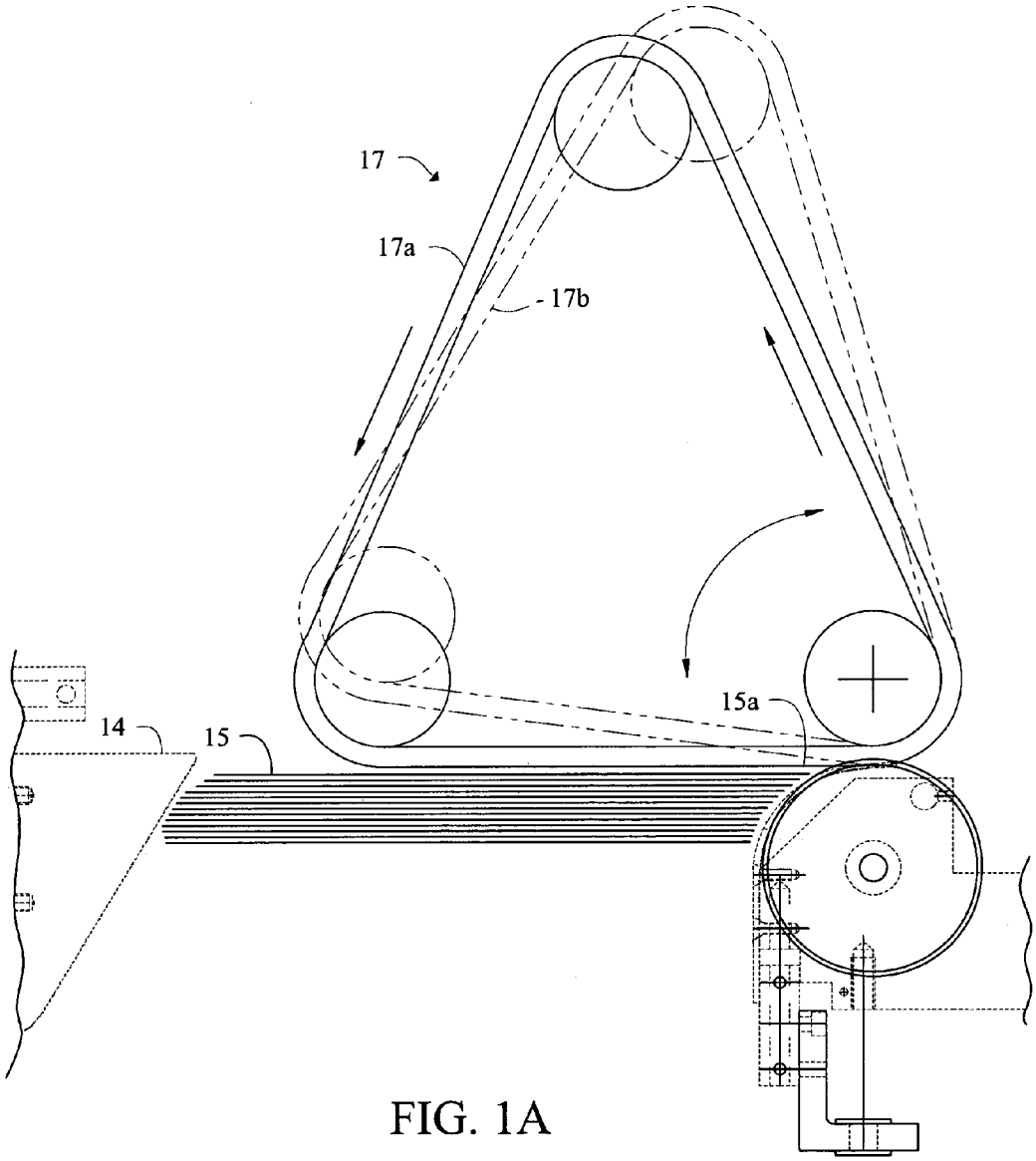
FIG. 1A is a detailed view of a pivotally mounted friction belt assembly that frictionally engages envelopes in the envelope hopper of the machine.

FIG. 1A depicts a pivotally mounted friction belt assembly denoted 17 as a whole. The friction belt follows a triangular path of travel as depicted and is mounted at the discharge end of the envelope hopper as best understood in connection with FIG. 1. When in an unpivoted position of repose, as indicated in solid lines 17*a* (FIG. 1A), it engages substantially the entire length of an envelope 15 to be frictionally engaged and moved out of the hopper. When in its pivoted position, as indicated in dotted lines 17*b*, the belt engages only the leading end 15*a* of the envelope. There is, theoretically, an infinite plurality of positions of pivotal adjustment between the fully unpivoted and the fully pivoted positions. When fully unpivoted, the friction belt exerts maximum driving force to each envelope as each envelope exits the hopper and when fully pivoted, the friction belts exerts a minimum driving force against each envelope as each envelope exits the hopper. Thus, varying degrees of pivoting between the two extreme positions exerts varying amounts of driving force to the envelopes as they exit the hopper.

At printer station 18, each envelope is individually printed and at first drier station 20, the ink applied at print station 18 is dried a first time. The path of travel of each envelope is then reversed by wheel 22 that has a large diameter so that the envelopes are not creased as they undergo said change in direction. The envelopes undergo a second change of direction at second wheel 24 that also has a large diameter for the same reason.

The ink on each envelope is dried a second time at second drier station 26 and undergoes a ninety-degree (90°) change of direction at third large-diameter wheel 28.

The long path of travel between wheels 22 and 24 also helps the ink to dry. More generally, the elongate "S"-shaped path of travel from print station 18 to wheel 28 is provided for the same reason, i.e., to increase the dwell time between the printer and sorter part of the machine that directs the items to the various collection bins.

A plurality of path-diverting devices, collectively denoted 30*a*, 30*b*, and 30*c* are used to divert pre-defined batches of said items into bins 32*a*, 32*b*, and 32*c*, respectively. Although three (3) path-diverting devices and three (3) bins are depicted, it should be understood that the number of path-diverting devices and the number of bins may be increased or decreased as required to meet the demands of various applications. The number of bins must be equal to the number of path-diverting devices.

Significantly, a first end of the printing and drying station is positioned at a discharge end of the elongate conveyor system. A second end of the printing and drying station is positioned at an input end of the elongate discharge apparatus. Accordingly, such parts collectively form a square inverted "U" configuration when machine 10 is in its operating configuration.

More particularly, longitudinally disposed conveyor means 12 and the longitudinally disposed discharge part of machine 10 (collectively formed by the path diverting devices and the bins) are parallel to one another and interconnected to one another by the transversely disposed printing and drying section of the machine (collectively formed by the aforementioned printing and drying stations and the large wheels). These parts collectively form the square "U" configuration. Accordingly, a worker in space 11 has unimpeded access to all three major parts of machine 10.

Each envelope remains in its on edge or vertical orientation as it travels through machine 10. Thus, each envelope remains in said vertical orientation as it travels through the path-diverting device that engages it and directs it into a bin.

Figure 1B:
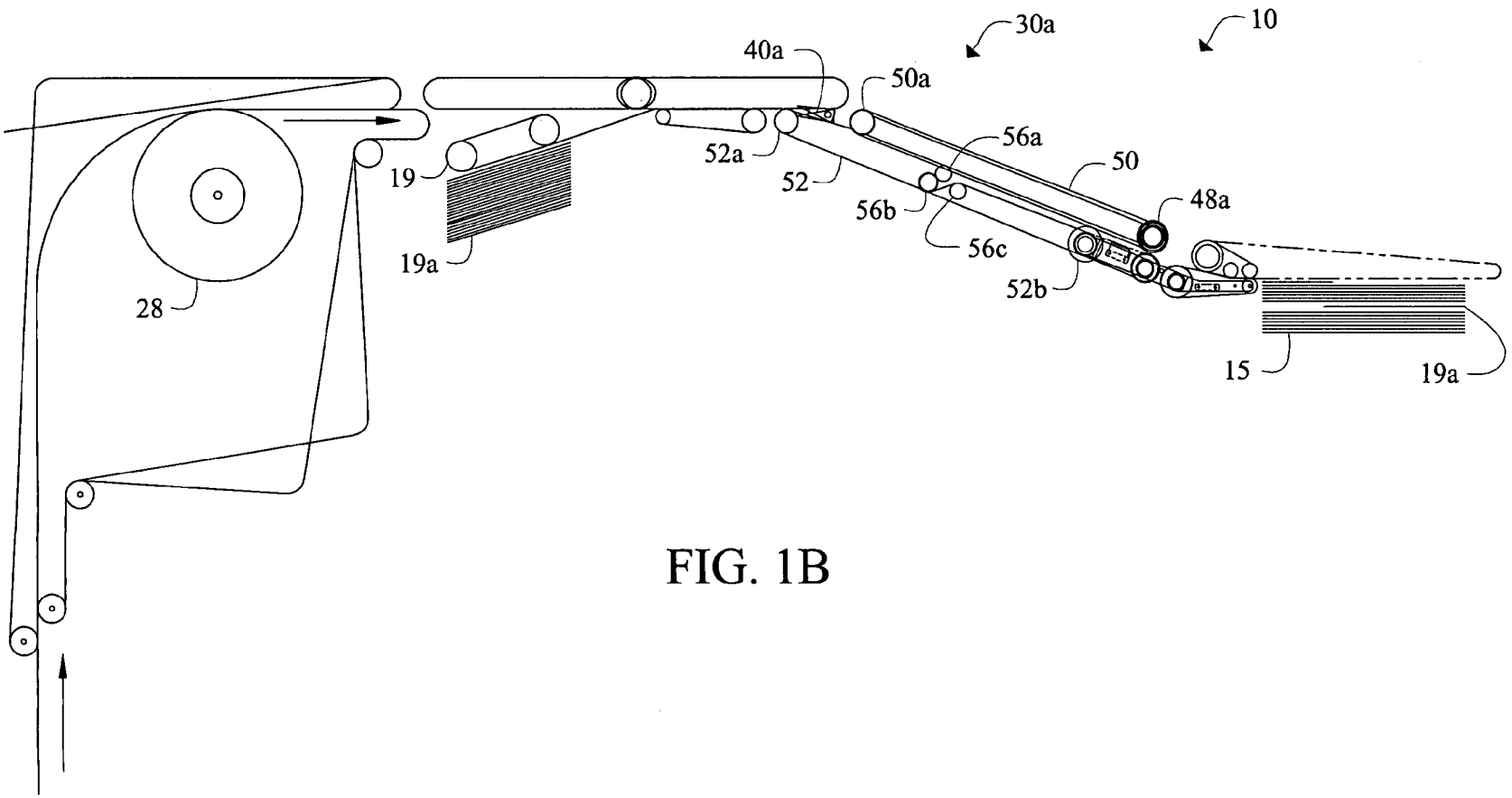
FIG. 1B is a top plan, diagrammatic view of the diverter or sorter section of the novel machine, depicting only one (1) bin but including a separator sheet feeder mounted upstream of the first deflector.

FIG. 1B provides a more diagrammatic view of a modified embodiment of machine 10 relative to FIG. 1. This embodiment includes a separator sheet feeder assembly 19 that feeds separator sheets 19*a* between bundles of envelopes or other items to be separated from one another. Sheet feeder assembly is positioned downstream of large wheel 28 and upstream of the path-diverting devices. The computer causes separator sheet feeder 19 to insert a separator sheet at the end of each bundle.

Figure 2:
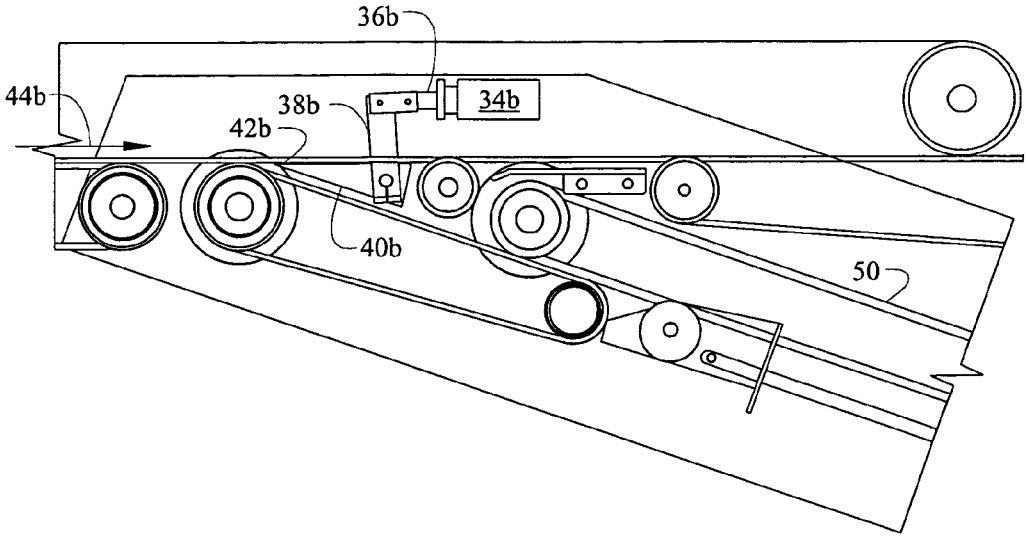
FIG. 2 is a detailed top plan view of the parts circled in FIG. 1 by the circle denoted 2, and depicting a solenoid in its de-activated configuration.
Figure 3:
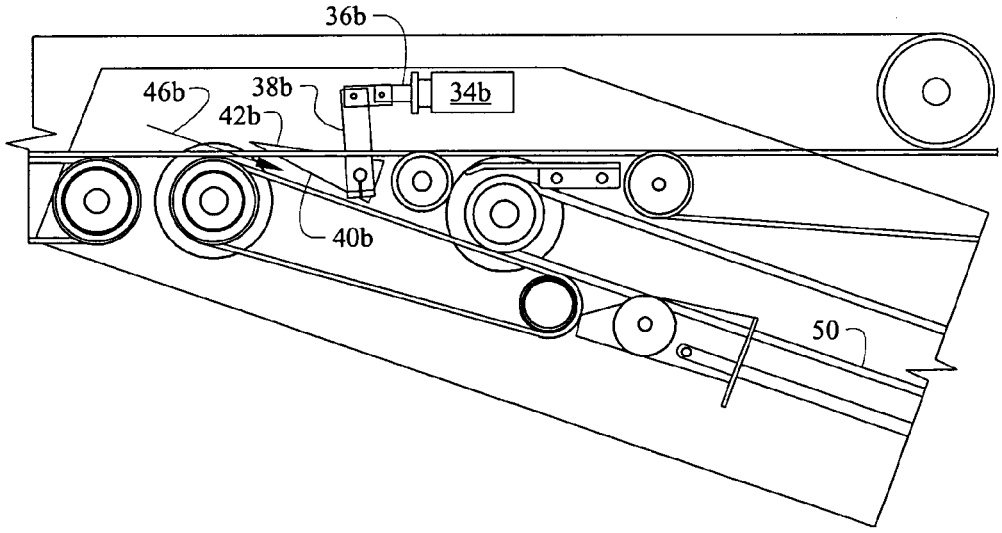
FIG. 3 is a detailed top plan view of the same parts depicted in FIG. 2 but with the solenoid in its activated configuration.

As depicted in FIGS. 2 and 3, each path-diverting means includes a solenoid 34*a*, 34*b*, 34*c* or similar device. Each solenoid includes an actuator 36*a*, 36*b*, 36*c* that is connected to link assembly 38*a*, 38*b*, 38*c*. Each link is pivotally connected to triangular diverter 40*a*, 40*b*, and 40*c*.

FIG. 2 depicts solenoid 36*b* in its de-activated state and FIG. 3 depicts said solenoid in its activated state.

Note in FIG. 2 that triangular diverter 40*b* has a leading end 42*b* that is positioned out of the path of travel of an envelope, not shown, following a path of travel denoted by directional arrow 44*b*. In FIG. 3, leading end 42*b* of said triangular diverter 40*b* is positioned in said path of travel and therefore diverts each envelope encountering it to follow a path of travel indicated by directional arrow 46*b*. In this way, envelopes are directed into their respective bins by the selective activation of said solenoids.

Each solenoid is controlled by a signal generated by a sensor positioned at print station 18 or at another suitable, upstream location. The sensor and associated signal-generating means are not a part of this invention, per se. The signal-generating means may include, for example, a detecting means for detecting a marking on the last envelope of a batch. When a marking is detected, the marker-detecting means generates a signal that is sent to the signal-generating means that controls the instantaneous position of each solenoid.

Figure 4:
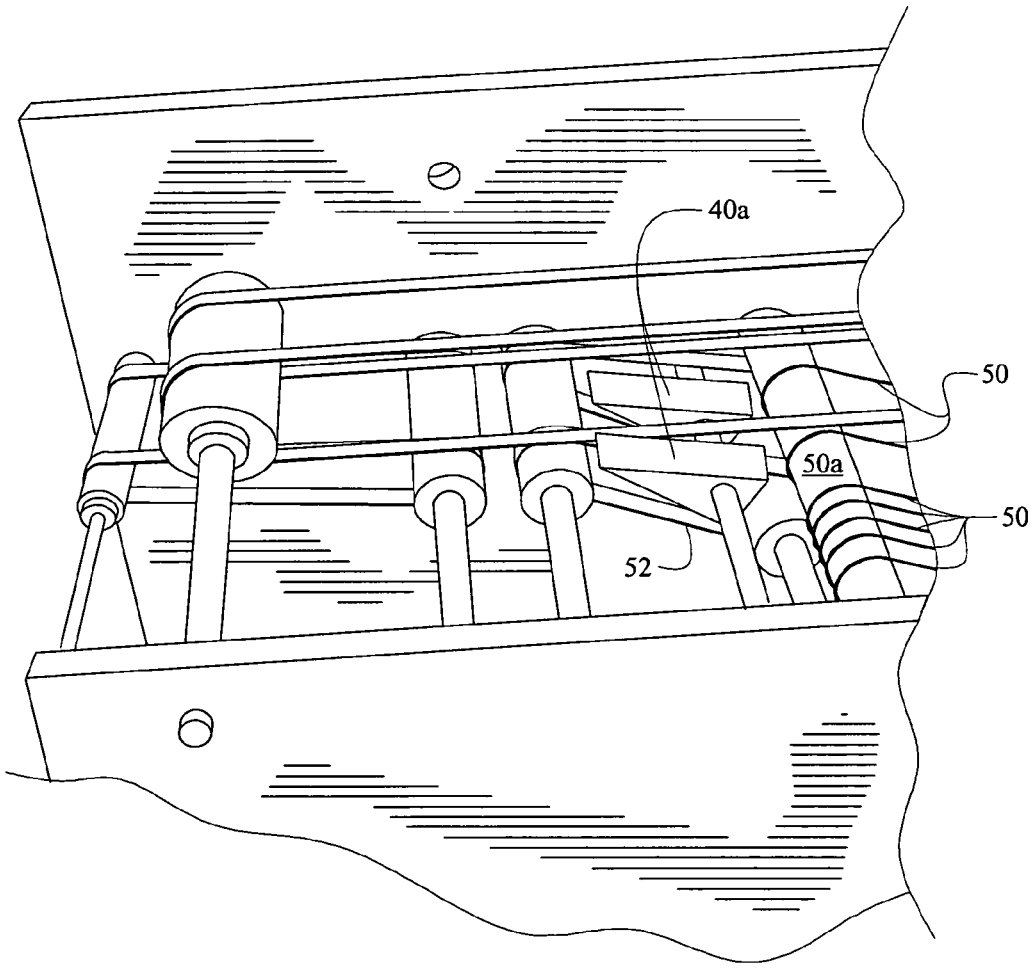
FIG. 4 is a perspective view of the diverter section of the machine.

FIG. 4 provides a simplified perspective view of triangular diverters 40*a* when in their raised position.

Returning briefly to FIG. 1, it will there be seen that each diverted envelope encounters a pair of opposed rollers, denoted 48*a*, 48*b*, 48*c*, depending upon into which bin 32*a*, 32*b*, or 32*c* the envelope has been directed. In the industry, the location where two opposed rollers meet is termed a "nip." Significantly, unlike the non-rotating rollers of machines that accumulate bundles of envelopes upstream of a nip, the opposing rollers in the present machine are continuously rotating unless stopped for brief periods of time to close gaps between envelopes as will be more fully set forth hereinafter. The rate at which each envelope is traveling is reduced when it encounters a nip but the envelope continues its forward travel. Accordingly, a trailing end of a leading envelope that has encountered a nip will be rammed by the leading end of the envelope trailing it because the trailing envelope has not yet encountered said nip and is therefore traveling at a higher rate of speed than the lead envelope.

Displacing the trailing end of each leading envelope so that it is moved out of the way of the leading end of its trailing envelope inventively solves this problem. This is accomplished in part by transporting envelopes in sandwiched relation between a plurality of vertically spaced apart O-rings and a plurality of vertically spaced apart flat belts that confront one another but which rotate in opposite directions to cooperatively carry individual envelopes to a bin after said envelopes have been diverted from a first path of travel. Such displacement is further accomplished by providing a plurality of vertically spaced apart protruding rollers that are positioned in the path of travel of each envelope being transported by said O-rings and flat belts.

As the leading end of each envelope encounters the protruding rollers, said leading end is constrained to travel over the protruding rollers, thereby placing the O-rings into a biased condition. Then, as the trailing end of each envelope clears the protruding rollers, the O-rings snap back into their respective positions of repose and thereby return the trailing end of each envelope to the path of travel it was following prior to encountering the protruding rollers.

Figure 5:
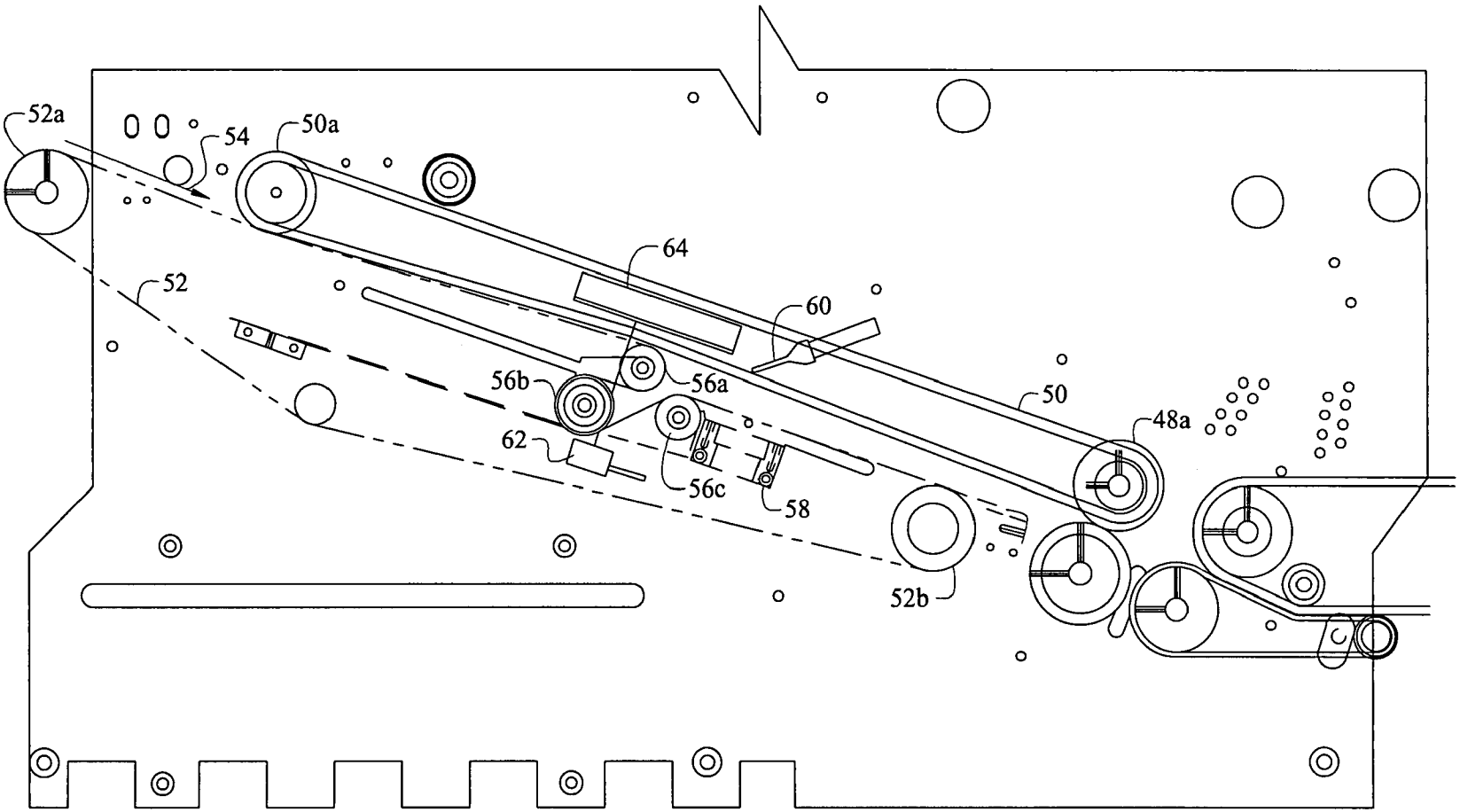
FIG. 5 is a top plan view of the protruding rollers and other parts of the mechanism that prevents striking of the trailing end of a leading item by the leading end of a trailing item when a leading item is slowed down by a nip.

The O-rings are collectively denoted 50 in FIG. 5 and the flat belts are collectively denoted 52. In this top view, the O-rings and flat belts below the top O-ring and flat belt are not visible.

Each O-ring and each flat belt has a roller at its opposite ends that rotates at a speed that determines the speed of the envelopes traveling through the diverter to the bin. The O-ring rollers are denoted 50*a* and 48*a*, the latter roller being one of the aforementioned nip rollers. The flat belt rollers are denoted 52*a* and 52*b*.

O-rings 50 and flat belts 52 rotate in opposite directions relative to one another at the same rate of speed so that the respective confronting parts of said O-rings and flat belts travel in the same direction at the same speed. An envelope or other item positioned in sandwiched relation between the O-rings and the flat belts, as indicated by arrow 54 at the left end of FIG. 5, is transported by the frictional engagement between said items and the O-rings on a first side thereof and the flat belts on a second side thereof.

Each envelope is oriented in a vertical plane as it is carried by O-rings 50 and flat belts 52. The envelopes are in a vertical plane at all times as they are handled by the various parts of machine 10 as mentioned earlier. Plural vertically spaced apart O-rings and flat belts are used because a typical envelope has a width that requires support at several vertically spaced apart locations to maintain the main body of the envelope in a vertical plane.

The protruding rollers are depicted in FIG. 5 and are denoted 56*a*. In this embodiment, the protruding rollers form a part of a three roller set of rollers denoted 56*a*, 56*b*, 56*c* arranged in a generally triangular pattern where the apex of the triangle is defined by protruding roller 56*a*. Rollers 56*b*, 56*c* are idlers that define the path of travel of flat belts 52. The diameter of each roller is made relatively large so that it need not rotate at an extraordinarily high rotational speed.

The leading end of each item is deflected when it encounters protruding rollers 56*a*, causing O-rings 50 to be deflected from their respective positions of repose. Significantly, such deflection of O-rings 50 is depicted in FIG. 5.

More particularly, each item is wider than the set of rollers 56*a*, so each item displaces the respective O-rings from their position of equilibrium as the protruding rollers deflect the item. As the trailing end of each item clears the protruding rollers, O-rings 50 snap back under their own resiliency into their respective positions of repose, not shown to avoid cluttering the drawings. This snaps the trailing end of the item that has just cleared the protruding rollers back into the path of travel that was being followed prior to the encountering of the protruding rollers. Accordingly, the trailing end of the item is snapped out of the way of the leading end of the next item that encounters the protruding rollers.

A plurality of vertically spaced apart openings are formed in vacuum block 58 positioned downstream of protruding rollers 56*a*. Each opening is in fluid communication with a remote source of negative pressure, not shown. Thus, the trailing end of each envelope is pulled by suction into overlying relation to the part of flat belts 52 that are downstream from protruding rollers 56*a*. The trailing end therefore does not bounce upon clearing the protruding rollers.

Air nozzle 60 is in fluid communication with a remote source of positive air pressure, not shown. Nozzle 60 blows air under positive pressure against each envelope flap as each flap passes the protruding rollers. This holds each flap firmly against the main body of the envelope so that a flap on a trailing envelope does not ram the flap of a leading envelope. Nozzle 60 is preferably mounted on flexible tubing so that its position is easily adjustable to accommodate envelopes or other items of various sizes.

Sensor 62 is preferably provided in the form of a photoelectric eye and includes reflector 64. It is positioned substantially in registration with protruding rollers 56*a*. Sensor 62 counts the pulses between envelopes that are spaced apart by a predetermined distance and thus it detects when a trailing envelope is spaced too far from the envelope in front of it. The pulse counts are fed to the machine's computer and the computer sends a signal to a clutch means that stops rotation of nip rollers 48*a* for an amount of time sufficient to allow a leading envelope to dwell upstream of the nip until the trailing item closes the gap to the predetermined proper gap, at which time the computer sends a signal to the clutch means to release nip rollers 48*a* so that said nip rollers can resume rotation.

For example, suppose that one thousand pulses are counted every time the gap between the trailing end of a leading item and the leading end of a trailing item is two inches. If the sensor then counts fifteen hundred pulses, a gap of three inches has been detected. If that is an unacceptable gap, the clutch stops rotation of nip rollers 48*a* for a very brief amount of time, thereby stopping the forward travel of the lead envelope until the trailing envelope closes the gap to an acceptable spacing and the clutch then releases the nip rollers so that the lead envelope may then resume its forward travel. This control system relies upon a computer program that is not expressly disclosed herein, but the writing of such a program is well within the ordinary skill of a programmer in view of this disclosure as to what is needed.

Various sensors other than a pulse-counting photoelectric eye may be used to perform this function and such other sensors are within the scope of this invention. Similarly, numerous computer programs may be written to control the activation and deactivation of the clutch means and devices other than clutches may be used to start and stop rotation of nip rollers 48*a*. The important function is to delay the forward travel of the lead item a time sufficient to enable the trailing item to close the gap to the gap required to accomplish the desired amount of shingling.

In this way, items traveling at a high rate of speed have sufficient dwell time for ink applied thereto to dry before the items encounter structures that could cause smearing of wet ink. Items slowing down as they approach the nip do not get rammed by the items trailing them. Significantly, this results in shingling of contiguous items, which shingling is made possible by the overtaking of a lead item by a trailing item in the absence of a collision. The variability of the strength of the driving force applied to envelopes leaving the hopper, the automatic insertion of separator sheets, the protruding rollers, the resiliency of the O-rings, the suction of the vacuum, the positive pressure provided to hold the flaps down, and the ability of the sensor to adjust excessive gaps between items to an acceptable gap all cooperate to enable the machine to operate at its highest speed of 60,000 items per hour.

Moreover, the elongate conveyor means and the multiple bins provide sufficient capacity to enable a single worker to keep the conveyor means well-supplied with envelopes or other items and to keep all of the bins from filling up at the same time. The square "U" shape of the machine further facilitates the performance of the various jobs performed by the worker.

It will thus be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

The invention claimed is:

1. A machine, comprising:

an elongate conveyor system for transporting items to a hopper;

a pivotally-mounted friction belt positioned with respect to said hopper such that an item in said hopper is substantially fully engaged along its length when said pivotally-mounted friction belt is in a fully unpivoted position and such that an item in said hopper is engaged only at a leading end thereof when said pivotally-mounted friction belt is in a fully pivoted position;

a printing and drying station where ink is applied to said items and dried;

an elongate discharge apparatus;

said elongate discharge apparatus including a plurality of longitudinally-spaced apart deflectors for diverting preselected items from a first path of travel to a second path of travel;

said elongate discharge apparatus including a plurality of bins, there being as many bins as there are deflectors;

said elongate conveyor system and said elongate discharge apparatus being disposed in parallel relation to one another;

said printing and drying station being disposed in interconnecting relation to said elongate conveyor system and said elongate discharge apparatus;

a first end of said printing and drying station being positioned at a discharge end of said elongate conveyor system;

a second end of said printing and drying station being positioned at an input end of said elongate discharge apparatus;

said elongate conveyor system, said printing and drying station, and said elongate discharge system collectively forming a square "U"-shaped configuration;

whereby an operator of said machine has unimpeded access to said elongate conveyor system, said printing and drying station, and said elongate discharge apparatus.

2. The machine of claim 1, further comprising:

a sensor including a signal-generating means that controls an instantaneous position of each deflector of said plurality of deflectors so that a preselected group of items may be diverted to a particular bin of said plurality of bins.

3. The machine of claim 1, further comprising:

each deflector of said plurality of deflectors having a first position and a second position;

said first position of each deflector being disposed in non-interfering relation to said first path of travel of an item so that said item remains on said first path of travel after passing said deflectors;

said second position of each deflector disposed in interfering relation to said first path of travel of said item so that said item is diverted to said second path of travel upon encountering said deflectors in said second position.

4. The machine of claim 3, further comprising:

each deflector of said plurality of deflectors being pivotally mounted;

a solenoid having an actuator linked to each deflector;

said solenoid having an inactivated state where said actuator maintains each deflector in said first position; and said solenoid having an activated state where said actuator causes pivotal motion of each deflector and places each deflector in said second position.

5. The machine of claim 4, further comprising:

a plurality of elongate O-rings rotatably mounted along said second path of travel in parallel, vertically spaced apart relation to one another;

a plurality of elongate flat belts rotatably mounted along said second path of travel in parallel, vertically spaced apart relation to one another;

said plurality of O-rings disposed in confronting relation to said plurality of flat belts;

said plurality of O-rings and said plurality of flat belts rotating in opposite directions at a common speed so that an item sandwiched between them is transported along said second path of travel;

each O-ring of said plurality of O-rings having a position of repose and being inherently resilient so that each O-ring of said plurality of O-rings quickly returns to said position of repose when displaced away from said position of repose and then released;

a plurality of vertically spaced apart protruding rollers positioned in protruding relation to said second path of travel so that an item traveling along said second path of travel is constrained to deviate from said second path of travel upon encountering said plurality of protruding rollers;

said items, upon deviating from said second path of travel, causing said O-rings to displace from their respective positions of repose;

the inherent resiliency of each O-rings of said first plurality of O-rings snapping a trailing end of said leading item back into the second path of travel as each item clears the protruding rollers so that the trailing end of each item does not interfere with the leading end of an item in trailing relation to said leading item.

6. The machine of claim 5, further comprising:

a nip defined by a pair of opposed rollers;

said nip being longitudinally spaced apart from and disposed between said protruding rollers and a discharge bin of said plurality of discharge bins;

each item having a first rate of travel that is slowed to a second rate of travel as its leading end encounters said nip;

said opposed rollers of said nip cooperatively rotating in opposite directions with one another at a common speed to feed said items toward a discharge bin of said plurality of discharge bins.

7. The machine of claim 6, further comprising:

a vacuum block mounted downstream of said protruding rollers, between said protruding rollers and said nip;

said vacuum block applying a suction to respective trailing ends of items as the respective trailing ends of said items clear said protruding rollers and are snapped out of the way of items;

whereby said respective trailing ends of said items traveling from said protruding rollers to said nip are subjected to a vacuum and thus any bouncing of said items caused by the snapping action of the O-rings is inhibited.

8. The machine of claim 6, further comprising:

an air nozzle mounted downstream of said protruding rollers, between said protruding rollers and said nip;

said items being envelopes having flaps;

said air nozzle applying a positive air pressure to respective flaps of envelopes as the respective trailing ends of said envelopes clear said protruding rollers and are snapped by said O-rings out of the way of the respective leading ends of the trailing items;

whereby said respective flaps are pushed into overlying relation to a main body of said envelopes so that said flaps are not rammed by the flaps of said trailing items.

9. The machine of claim 6, further comprising:

a sensor positioned in substantial registration with said protruding rollers that determines whether two contiguous items are longitudinally spaced apart from one another by a predetermined distance;

said sensor operable to stop rotation of said opposed rollers of said nip for a predetermined period of time if the gap between said two contiguous items is greater than said predetermined distance so that said gap is shortened to a distance within said predetermined distance.

10. The machine of claim 1, said pivotally-mounted friction belt being positionable in an infinite number of pivotal positions of adjustment between said fully unpivoted and fully pivoted positions;

the amount of driving force imparted to envelopes exiting said hopper being variable by adjusting the amount of pivoting of said pivotally-mounted friction belt.

11. The machine of claim 1, further comprising:

a separator sheet feeder positioned downstream of said printing and drying station and upstream of said elongate discharge apparatus;

said separator sheet feeder adapted to insert a separator sheet between contiguous bundles of said items.

12. A machine, comprising:

an elongate conveyor system for transporting items to a hopper;

a printing and drying station where ink is applied to said items and dried;

an elongate discharge apparatus;

said elongate discharge apparatus including a plurality of longitudinally-spaced apart deflectors for diverting preselected items from a first path of travel to a second path of travel;

said elongate discharge apparatus including a plurality of bins, there being as many bins as there are deflectors;

said printing and drying station being disposed in interconnecting relation to said elongate conveyor system and said elongate discharge apparatus;

a plurality of elongate O-rings rotatably mounted on said elongate discharge apparatus along said second path of travel in parallel, vertically spaced apart relation to one another;

a plurality of elongate flat belts rotatably mounted on said elongate discharge apparatus along said second path of travel in parallel, vertically spaced apart relation to one another and in confronting relation to said plurality of O-rings;

said plurality of O-rings and said plurality of flat belts rotating in opposite directions at a common speed so that items sandwiched between them are transported along said second path of travel;

a plurality of vertically spaced apart protruding rollers positioned in protruding relation to said second path of travel so that items traveling along said second path of travel are constrained to deviate from said second path of travel upon encountering said plurality of protruding rollers;

said items, upon deviating from said second path of travel, causing said O-rings to displace from respective positions of repose;

resiliency of each O-ring of said first plurality of O-rings snapping a trailing end of each item back into the second path of travel as each item clears the protruding rollers so that the trailing end of a lead item does not interfere with a leading end of an item in trailing relation to said lead item.

13. A machine, comprising:

an elongate conveyor system for transporting items to a hopper;

a printing and drying station where ink is applied to said items and dried;

an elongate discharge apparatus;

said elongate discharge apparatus including a plurality of longitudinally-spaced apart deflectors for diverting preselected items from a first path of travel to a second path of travel;

said elongate discharge apparatus including a plurality of bins, there being as many bins as there are deflectors;

said printing and drying station being disposed in interconnecting relation to said elongate conveyor system and said elongate discharge apparatus;

a plurality of vertically spaced apart protruding rollers positioned on said elongated discharge apparatus in protruding relation to said second path of travel so that items traveling along said second path of travel are constrained to deviate from said second path of travel upon encountering said plurality of protruding rollers;

a nip defined by a pair of opposed rollers;

said nip being longitudinally spaced apart from and disposed between said protruding rollers and a discharge bin of said plurality of discharge bins;

an air nozzle mounted downstream of said protruding rollers, between said protruding rollers and said nip;

said items being envelopes having flaps;

said air nozzle applying a positive air pressure to respective flaps of envelopes as respective trailing ends of said envelopes clear said protruding rollers, whereby said respective flaps are pushed into overlying relation to a main body of said envelopes so that said flaps are not rammed by the flaps of trailing items.

* * * * *